United States Patent [19]

Sonneville

[11] 4,111,361

[45] Sep. 5, 1978

[54] DEVICE FOR INSULATING AND FASTENING RAILWAY RAILS

[75] Inventor: Roger Paul Sonneville, Saint-Cloud, France

[73] Assignee: Suprotec S.A., Fribourg, France

[21] Appl. No.: 780,999

[22] Filed: Mar. 24, 1977

[30] Foreign Application Priority Data

Apr. 8, 1976 [FR] France ..... 76 10233

[51] Int. Cl.[2] ..... E01B 9/28

[52] U.S. Cl. ..... 238/338; 174/138 D; 238/107; 238/349

[58] Field of Search ..... 238/310, 315, 338, 343, 238/349, 351, 107, 108, 152, 153, 154, 155, 156, 157, 158, 159, 160, 161; 174/138 R, 138 D

[56] References Cited

U.S. PATENT DOCUMENTS

| | | | |
|---|---|---|---|
| 3,246,843 | 4/1966 | Pineau | 238/152 |
| 3,254,840 | 6/1966 | Chartet | 238/349 |

FOREIGN PATENT DOCUMENTS

| | | | |
|---|---|---|---|
| 552,347 | 11/1956 | Belgium | 238/351 |
| 1,244,383 | 9/1960 | France | 238/349 |
| 2,269,783 | 11/1975 | France | 174/138 D |
| 2,273,116 | 12/1975 | France | 238/349 |
| 866,345 | 4/1961 | United Kingdom | 238/349 |

*Primary Examiner*—Randolph A. Reese

*Attorney, Agent, or Firm*—Wenderoth, Lind & Ponack

[57] ABSTRACT

The device comprises a metal fastener which bears against the flange of the rail and against the rail support. An insulating element is combined with the fastener for insulating the fastener from the support and insulating the fastener from a fixing bolt which extends through an aperture in the fastener and is anchored in the rail support. The insulating element is in one piece and comprises a planar branch having an aperture for the passage of the fixing means and a loop portion which is so shaped as to ensure the elastic mounting of the insulating element on the fastener and to be interposed between the fastener and the support.

8 Claims, 4 Drawing Figures

DEVICE FOR INSULATING AND FASTENING RAILWAY RAILS

BACKGROUND OF THE INVENTION

The present invention relates to devices for fastening railway rails and more particularly to improvements in these devices as concerns the electrical insulation of the rail and the ease with which the device is employed.

Among the systems for fastening railway rails to concrete sleepers or ties belonging to the "screwed" type of fasteners, that is to say fasteners clamped by bolts or coach-screws, the systems most often used with concrete sleepers employ a metal fastener having on one side a nose portion which bears on the flange of the rail and, on the opposite side, a loop portion or heel of cylindrical shape which bears in a cavity of complementary shape formed in the upper face of the sleeper. The insulation of the rail from the sleeper when required, in particular for signalling with the aid of the track circuit, is usually achieved by the interposition of the following elements:

- an elastic and insulating sole or pad placed between the flange of the rail and the support face of the sleeper;
- a washer of insulating material comprising a spigot, this washer being placed between, on one hand, the metal fastener and, on the other, the bolt and nut assembly to avoid any contact between the fastener and the clamping means;
- a metal washer interposed between the nut and the insulating washer to ensure that the insulating washer, which is of a relatively fragile material, is not crushed or sheared under the effect of the very high pressure exerted by the nut;
- a pad or liner of insulating material interposed between the loop portion or heel of the fastener and the cavity of the sleeper.

The drawback of such a device resides above all in the multiplicity of the parts, the distribution and positioning of which require on the track laying site costly manpower and supervision and present a risk of bad workmanship and loss.

An effort has been made to overcome this drawback (French Pat. No. 1,282,099) by forming an assembly of the insulating washer and pad with the basic metal fastener by adhesion or by the use of vulcanized elastomers bonded to the steel of the fastener. But such a process is costly and requires much care to ensure a strong bonding which renders it unsuitable for mass-production on an industrial scale. The mere replacement of an insulating washer or pad is moreover impossible since it is necessary to replace a complete assembly of the fastening device and to return the metal fastener to the factory to provide it with a new insulating washer or pad.

SUMMARY OF THE INVENTION

An object of the present invention is to overcome these drawbacks and to provide insulating means which may be manufactured industrially and which are easy to use and provide an effective insulation.

According to the invention, there is provided an insulating element for association with a metal fastener cooperating with a rail, its support and fixing means, the insulating element being constructed in a single piece and comprising a roughly planar branch provided with an aperture for the passage of the fixing means, an annular spigot coaxial with the aperture, and a loop portion which is so shaped as to ensure an elastic mounting of the insulating element on the fastener and to insulate the fastener from the support.

According to other features:

- the loop portion has a generally cylindrical shape and has in section in a plane perpendicular to its axis, the shape of an arc of a circle which subtends an angle at the center exceeding 180°;
- such arc of a circle has a radius slightly less than the radius of the adjacent cylindrical portion of the fastener;
- in the region of the loop portion, the insulating element has less thickness along two opposed lateral edges thereof;
- the spigot has at its free end at least one hooking means for hooking onto the fastener;
- the insulating element carries a metal plate which is held in position, for example by bosses which are in one piece with the remainder of the insulating element and engaged with the top of the plate.

Another object of the invention is to provide a device for fastening a rail on a support, of the type comprising a metal fastener bearing on the flange of the rail and on the support, and at least one fixing means, such as a bolt associated with a nut, extending through an aperture formed in the fastener, and means for electrically insulating these various elements, wherein the insulating means comprise an element in one piece corresponding to the definition given hereinbefore.

According to one particular embodiment, the aperture formed in the fastener for the passage of the fixing means has an oblong shape the large axis of which is oriented transversely of the longitudinal direction of the rail.

The invention will now be described in more detail with reference to the accompanying drawings which illustrate two embodiments of the invention.

DETAILED DESCRIPTION OF THE INVENTION

Figure 1:
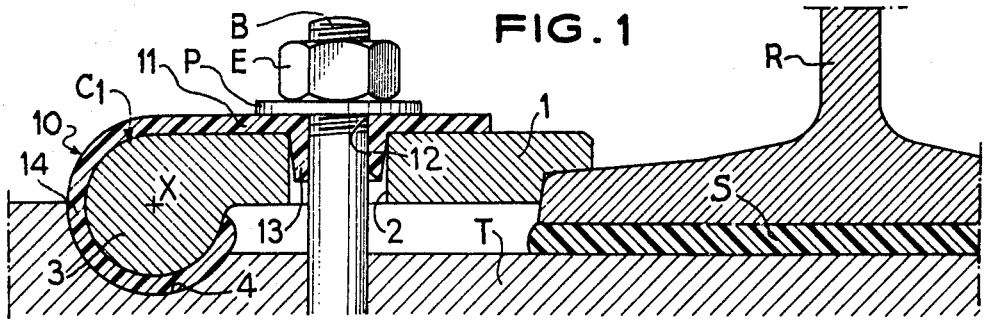
FIG. 1 is a sectional view, in a vertical plane perpendicular to the longitudinal axis of the rail, of a fastening device according to the invention.

FIG. 1 shows a rail R which bears on a concrete sleeper or tie T through an insulating sole or pad S. A metal fastener C1 maintains the rail in position in association with fixing means comprising a bolt B, a nut E and a metal plate or washer P. In the presently-described embodiment, the fastener C1 is constituted by a massive steel member comprising a horizontal branch 1 which bears against the flange or foot of the rail and is provided with an aperture 2 for the passage of the bolt, and a heel 3 having a cylindrical outer shape adapted to be received in a cavity 4 of complementary shape formed in the upper face of the sleeper.

Figure 2:
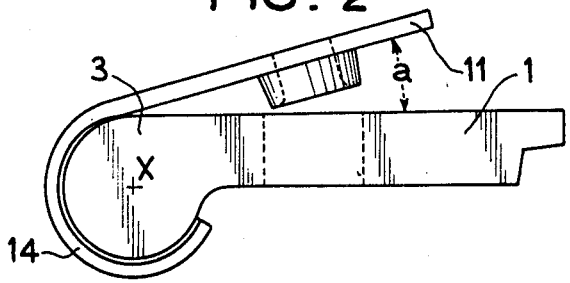
FIG. 2 is a side elevational view showing the mounting of an insulating element on a fastener.

This device is completed by an insulating element 10 which is rather rigid but slightly elastically deformable and comprises a substantially planar branch 11 provided with an aperture 12 for the passage of the bolt. Extending from this horizontal branch is an annular spigot 13 which extends into the aperture 2 of the fastener and insulates the latter from the bolt B. The branch 11 is extended, on the opposite side of the aperture 2 to the rail R, by a cylindrical loop portion 14 which surrounds the cylindrical portion of the heel 3 and subtends an angle at the center exceeding 180°. This heel and loop portion 14 are centered on the same axis X—X. The inside radius of the loop portion is slightly less than that of the cylindrical portion of the heel 3. Moreover, as can be seen more clearly in FIG. 2, in the region of the loop portion, the insulating element is slightly thinner along its two lateral opposed edges. This insulating element is preferably produced by moulding a relatively rigid insulating synthetic resin.

The insulating element and the fastener are assembled by first placing these two parts side-by-side, the two cylindrical portions being centered on the same axis X—X, and then engaging the loop portion 14 on the heel 3 by a relative displacement along the axis X—X. This operation is facilitated by the reduced thickness of the insulating element along the two lateral edges of the loop portion, this feature also making it possible to open the loop portion 14 for lateral introduction over heel 3 and to improve the elastic clamping of the loop portion on the heel. When the axis of the spigot 13 is brought into the vertical plane of symmetry of the fastener, the insulating element 10 is turned about the axis X—X through an angle *a* so as to engage the spigot 13 in the aperture 2 and bring the branch 11 against the branch 1 of the fastener.

The fastener and its insulating element are now assembled and may be easily handled to construct the fixing device shown in FIG. 1. Once they are assembled in this way, the fastener and the insulating element are perfectly immobilized with respect to each other, and, in particular, the insulating element can in no way turn with respect to the fastener before the fixing bolt is tightened. The loop portion 14 therefore performs not only the function of a connection between its end regions which provide the insulations between the fastener, the bolt and the sleeper, but also functions to effectively hook and position the insulating element on the fastener. Note that in order to facilitate the engagement of the spigot 13 in the aperture 2, the spigot may have a slightly frustoconical outer shape. By way of a modification, the aperture 2 may have an oblong section, the major axis of which is oriented in the direction of the plane of symmetry of the fastener extending transversely of the longitudinal axis of the rail.

Figure 3:
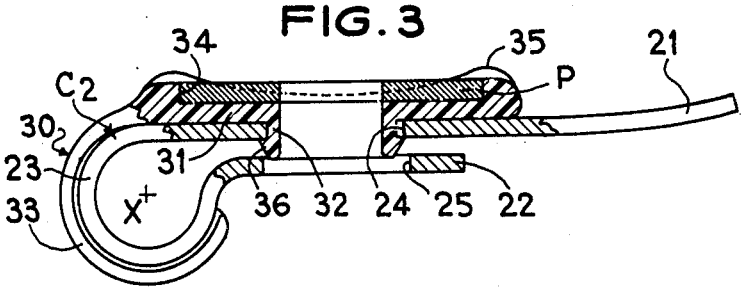
FIG. 3 is a side elevational view, partly in section, of another embodiment of a fastener provided with its insulating element.
Figure 4:
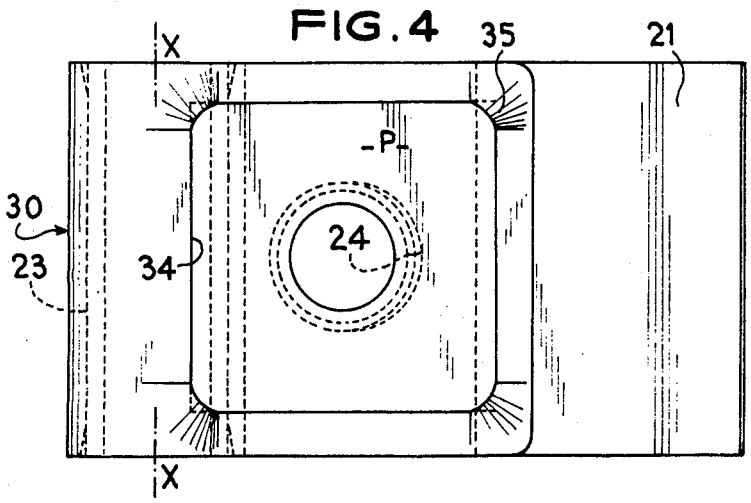
FIG. 4 is a top plan view of the embodiment shown in FIG. 3.

In the embodiment shown in FIGS. 3 and 4, the insulating element 30 is associated with an elastically yieldable fastener C2 of the type comprising two roughly parallel branches 21, 22 which are interconnected by a loop portion 23 and in which apertures 24, 25 are provided for the passage of the fixing means. The general shape of the insulating element corresponds to that described with reference to FIGS. 1 and 2. This insulating element consequently comprises a substantially planar branch 31, a spigot 32 and a loop portion 33. Note, moreover, that, in its upper face, the branch 31 defines a cavity 34 for a metal pressuredistributing plate P which is maintained in position by beadings 35 which are formed over the top of each corner of the plate P. Preferably, these beadings are integral with the insulating element and are formed over by a process, such as by means of ultra-sonic under pressure, so that the insulating element and the metal plate may be delivered in the form of a single unit.

Moreover, the spigot has at its free end lip portions or a continuous flange 36 which is adapted to engage or hook under the branch 21 of the fastener. As before, the aperture formed in the branch 21 may have an oblong section the major axis of which is oriented in the plane of symmetry of the fastener and insulating element to facilitate the engagement of the spigot in the aperture 24.

The very important advantages of the device according to the present invention from the practical point of view are mainly the following:

- there is no risk of the insulating element according to the invention being displaced after it has been placed in position and in particular there is no risk of its turning about the axis of the bolt B when the nut E is tightened. The torque exerted about the axis of the bolt, and transmitted by friction by the nut through the washer P to the insulating element, is indeed absorbed owing to the stiffness in the horizontal plane of the planar branch 11 which is extended by the cylindrical loop portion 14 which is interposed between the cavity 4 and the heel 3 of the fastener;
- the single-piece insulating element may be industrially mass-produced;
- it is mounted on the fastener very simply by the engagement of the loop portion 14 or 33 on the heel 3, 23 of the fastener and the engagement of the spigot 13 or 32 in the aperture of the fastener;
- the fastener and insulating element then form an assembly which may be easily handled;
- the number of parts relative to the prior art is substantially reduced and this accelerates and simplifies the track-laying operation;
- in the case of deterioration of the insulating element, it may be easily changed by unskilled labor and no return to the factory for bonding is necessary.

Having now described my invention what I claim as new and desire to secure by Letters Patent is:

1. A device for fastening a rail provided with a flange to a support, said device comprising a metal fastener for bearing against the flange of the rail and against the support, fixing means for fixing the fastener to the support, at least one aperture formed in the fastener for the passage of the fixing means, and means for electrically insulating the fastener from the support and for electrically insulating the fastener from the fixing means, said insulating means comprising an insulating element which is constructed in one piece and which comprises a substantially planar branch which defines an aperture for the passage of the fixing means and a loop portion which is so shaped as to ensure the elastic mounting of the insulating element on the fastener and to insulate the fastener from the support, said loop portion having a generally cylindrical shape and having the shape, in a section in a plane perpendicular to the generatrices of the loop portion, of an arc of a circle which subtends an angle at the center exceeding 180°, said fastener having a partially cylindrical portion, and said arc of a circle having a radius slightly less than the radius of said partially cylindrical portion of the fastener, thereby providing a tight fit between said loop portion of said insulating element and said partially cylindrical portion of said fastener.

2. A device as claimed in claim 1, wherein the insulating element has in the region of the loop portion a thickness which is less along two opposed lateral edges of the loop portion than in the center part thereof, thus facilitating assembly of the insulating element to the fastener.

3. A device as claimed in claim 1, wherein the substantially planar branch carries an annular spigot coaxial with the aperture in the branch for the passage of the fixing means.

4. A device as claimed in claim 3, wherein the spigot has a generally frustoconical shape.

5. A device as claimed in claim 3, wherein the spigot has on an end thereof remote from the branch at least one projecting portion for hooking onto the fastener.

6. A device as claimed in claim 1, further comprising a metal plate disposed on an upper face of the insulating element, and means for maintaining the plate in position on the insulating element.

7. A device as claimed in claim 6, wherein said maintaining means are bosses which are in one piece with the insulating element and engage the top of the plate.

8. A device as claimed in claim 1, wherein the aperture in the fastener for the passage of the fixing means has an oblong shape the major axis of which oblong shape is oriented transversely of the longitudinal direction of the rail.

* * * * *